US005495287A

United States Patent [19]

Kasai et al.

[11] Patent Number: 5,495,287

[45] Date of Patent: Feb. 27, 1996

[54] MULTIPLE-TONE DISPLAY SYSTEM

[75] Inventors: Naruhiko Kasai, Fujisawa; Hiroyuki Mano, Chigasaki; Shigeyuki Nishitani, Ebina; Isao Takita, Fujisawa; Kohji Takahashi, Mobara, all of Japan

[73] Assignee: Hitachi, Ltd., Tokyo, Japan

[21] Appl. No.: 18,494

[22] Filed: Feb. 17, 1993

[30] Foreign Application Priority Data

Feb. 26, 1992 [JP] Japan ..... 4-039203

[51] Int. Cl.[6] ..... G09G 3/36

[52] U.S. Cl. ..... 345/89; 345/147; 345/100

[58] Field of Search ..... 345/147, 153, 345/89, 88, 155, 94, 208, 210, 211, 100

[56] References Cited

U.S. PATENT DOCUMENTS

| | | | |
|---|---|---|---|
| 5,030,947 | 7/1991 | Dieudonne et al. | 345/147 |
| 5,089,812 | 2/1992 | Fuse et al. | 345/147 |
| 5,189,407 | 2/1993 | Mano et al. | 345/88 |
| 5,196,738 | 3/1993 | Takahara et al. | 345/147 |

OTHER PUBLICATIONS

"Lecturing thesis C–480", T. Yamaguchi, et al, Spring National Meeting of the Institute of Electronics, Information and Communication Engineers of Japan, 1991.

*Primary Examiner*—Tommy P. Chin
*Assistant Examiner*—A. Au
*Attorney, Agent, or Firm*—Antonelli, Terry, Stout & Kraus

[57] ABSTRACT

A dot matrix display system for multiple-tone displays, including a display device in which pixels are arrayed in a matrix shape, an LC (liquid-crystal) drive signal generator which converts color display data into LC display data, an 8-level data driver which selects one of 8-level voltages in accordance with the LC display data and then delivers the selected voltage, and an 8-level applied LC voltage generator by which the 8-level voltages to be applied to the pixels are produced so as to substantially make uniform color differences between the respectively adjacent tones of the multiple-tone displays. Owing to the substantially uniform color differences between the respectively adjacent tones, multiple-tone displays which are uniformly seen by the human eye can be obtained.

11 Claims, 15 Drawing Sheets

MULTIPLE-TONE DISPLAY SYSTEM

BACKGROUND OF THE INVENTION

1. Field of the Invention

The present invention relates to a display system of the dot matrix type, and a display method therefor. More particularly, it relates to a method of driving a display system for presenting multicolor/multiple-tone (or polytonal) displays, and a system therefor.

2. Description of the Related Art

An LC (liquid-crystal) display system in the prior art displays an image in such a way that interface signals received as external inputs are converted into drive signals for driving the LC display system, the drive signals are delivered to LC drive means, and the LC drive means accepts for 8-level display data among the delivered drive signals every horizontal line of a frame and then applies the accepted data to an LC panel as 8-level LC drive voltages conforming to the display data. With this mode, 8 tones or gradations are displayed by the 8-level voltages divided uniformly or equally, as stated in "Lecturing thesis C-480", the Spring National Meeting of the Institute of Electronics, Information and Communication Engineers of Japan, 1991.

FIG. 5 of the accompanying drawings illustrates the circuit arrangement of an 8-level uniform applied LC voltage generator (a generator by which the 8-level uniform voltages to be applied to the LC panel are produced) in the prior art. Numeral 27 indicates an LC driving supply voltage, which is divided into the 8-level voltages by resistors 28–36. Operational amplifiers 37–44 are respectively connected to the nodes of the adjacent resistors 28–36. Herein, the 8-level uniform voltages 22 to be applied to the LC panel (8-level voltages V1–V8) are produced by equalizing all the resistances of the resistors 29–35. The values of the voltages V1–V8 on this occasion are listed in Table 1 below. As can be understood from this table, all the voltage differences between the respectively adjacent levels are 0.7 [V].

TABLE 1

| TONE | VOLTAGE VALUE [V] |
|---|---|
| #1 | 6.50 |
| #2 | 5.80 |
| #3 | 5.10 |
| #4 | 4.40 |
| #5 | 3.70 |
| #6 | 3.00 |
| #7 | 2.30 |
| #8 | 1.60 |

FIG. 8 is a diagram showing an example of the relationship between the applied voltage to the LC panel and the display intensity or brightness of this LC panel in the prior art. The levels of the display intensity correspond respectively to the 8-level applied LC voltages V1–V8 obtained by uniformly dividing the supply voltage 27. In the illustrated graph, the display intensity levels are plotted on a logarithmic scale.

In this manner, the 8-level applied LC voltages are based on the uniform voltage division in the prior-art example. The uniform LC voltages incur the problem that the displayed tones are not always seen uniformly or in a well-balanced manner by the human eye.

SUMMARY OF THE INVENTION

An object of the present invention is to provide a method of and a system for presenting multiple-tone displays in which tones or gradations are made visible to the human eye uniformly or in a well-balanced manner in consideration of the optical characteristics of the displays.

In the present invention, the object is accomplished by contriving 8-level applied LC voltage generation means so as to make uniform or equalize the color differences between the respectively adjacent tones of a tonal display operation.

In one aspect of performance of the present invention, a multiple-tone display system wherein multiple-tone representations are presented on a display device which has a large number of pixels arrayed in a dot matrix shape comprises a data converter for receiving multiple-tone display information which contains a plurality of bits per pixel, and then sequentially converting the multiple-tone display information into display data which correspond to one horizontal line of the display device; a drive voltage generator for generating a plurality of drive voltage levels which substantially make uniform color differences between respectively adjacent ones of a plurality of tones that can be displayed by the multiple-tone display information containing the plurality of bits per pixel; a data driver connected to the drive voltage generator and data converter, for selecting one of the plurality of drive voltage levels from the drive voltage generator for every pixel on one line of the display device and then applying the selected drive voltage level to the display device in accordance with the display data delivered from the data converter; and a scan driver for selecting one of the horizontal lines of the display device which is to be successively displayed, in synchronism with the operations of the data converter and data driver.

According to the above construction of the present invention, the multiple-tone or polytonal representations which can be seen uniformly or in a well-balanced manner by the human eye can be realized by uniformalizing or equalizing the color differences between the respectively adjacent tones in a tonal display operation. Such a function and effect will be clarified from the following detailed description of embodiments read with reference to the accompanying drawings.

DETAILED DESCRIPTION OF THE PREFERRED EMBODIMENTS

First, an embodiment of the present invention will be described with reference to FIG. 1, FIGS. 3 and 4, FIGS. 6 and 7, FIGS. 9 thru 14, and Table 2.

Figure 1:
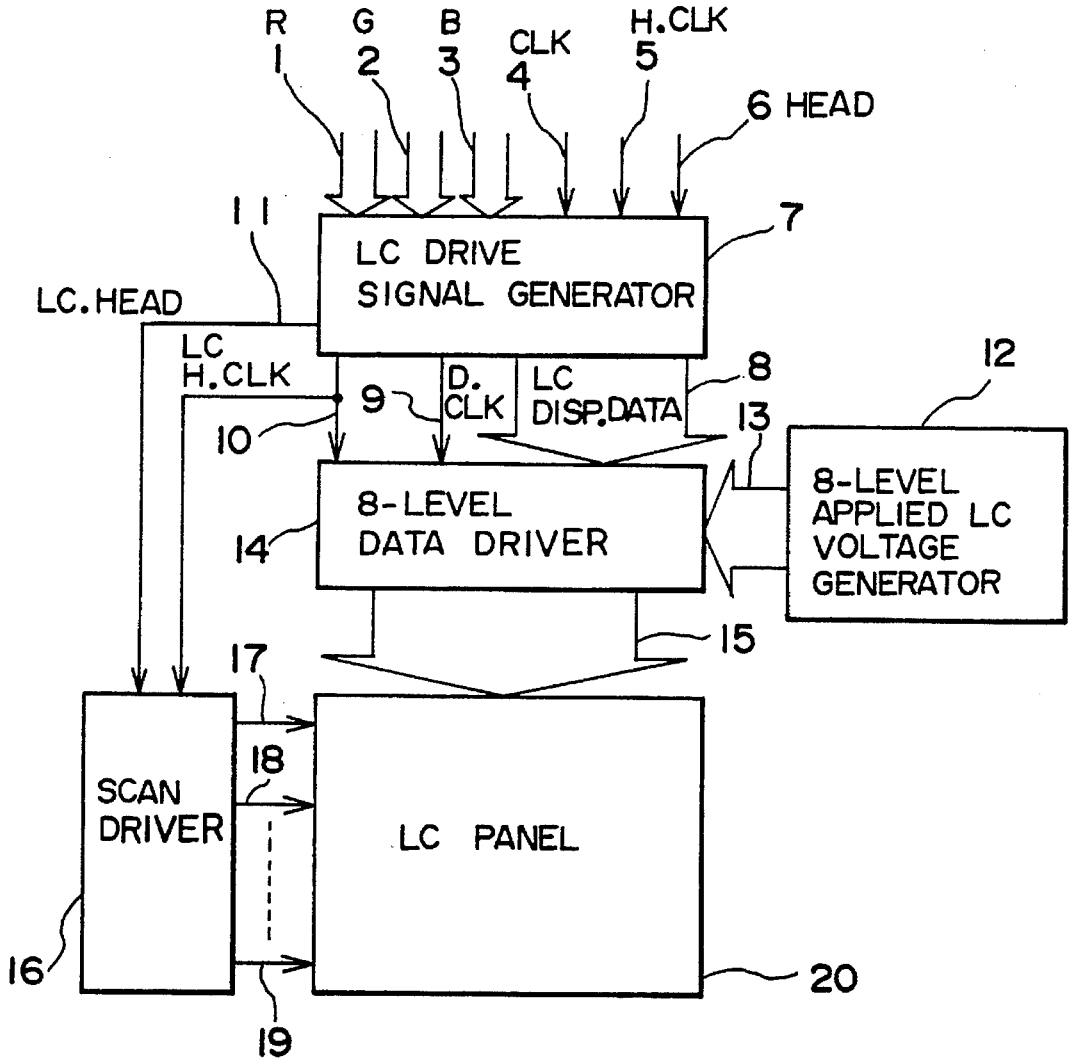
FIG. 1 is a block diagram of an embodiment of an 8-tone display system which adopts the present invention.

FIG. 1 is a block diagram of the embodiment of a multiple-tone display system to which the present invention is applied. Referring to the figure, numeral 1 indicates "red" input display data, numeral 2 "green" input display data, numeral 3 "blue" input display data, and numeral 4 a clock signal. A set of input display data 1–3 correspond to one pixel, and is fed set by set in synchronism with the clock signal 4. Each of the red input display data 1, green input display data 2 and blue input display data 3 is composed of 3 bits and represents any of 8 tones. Here, the word "pixel" is intended to mean one lighting element for red, green or blue, and 3 pixels constitute one dot in the case of a color display system. The details of such pixels will be explained later. Further, numeral 5 indicates a horizontal clock signal, and numeral 6 a head signal. The display data corresponding to one horizontal line are fed in one cycle of the horizontal clock signal 5 (one horizontal period). Besides, the head signal 6 indicates the head line of the display data, and the display data corresponding to one frame are fed in one cycle of the head signal 6. The multiple-tone display system in this embodiment comprises an LC (liquid-crystal) drive signal generator 7, which produces LC display data 8, a data clock signal 9, an LC horizontal clock signal 10 and an LC head signal 11. The LC drive signal generator 7 rearranges the input display data 1–3 into the order of R (red) pixels, G (green) pixels and B (blue) pixels for the purpose of presenting LC displays, whereupon it delivers the display data for 8 pixels in parallel. In this regard, each display data for one pixel is composed of 3 bits representing any of the 8 tones as stated before. Besides, the LC drive signal generator 7 receives the clock signal 4, horizontal clock signal 5 and head signal 6 so as to produce the data clock signal 9, LC horizontal clock signal 10 and LC head signal 11, respectively.

An 8-level applied LC voltage generator 12 produces 8-level voltages 13 which are to be applied to an LC panel 20. As will be explained later, the 8-level applied LC voltages 13 are obtained by dividing an LC driving supply voltage (27 in FIG. 9) nonuniformly. An 8-level data driver 14, a typical example of which is a product "HD66310" manufactured by Hitachi, Ltd., accepts the LC display data 8 for one horizontal line in accordance with the data clock signal 9. Thereafter, it shifts the accepted data to its output stage in synchronism with the LC horizontal clock signal 10. In accordance with the shifted data, one level is selected for each of the output data lines of the 8-level data driver 14 from among the 8-level applied LC voltages 13, whereby LC horizontal data 15 are output. Accordingly, the 8-level data driver 14 delivers as the output LC horizontal data 15 the LC display data 8 of a horizontal line which is one line precedent to the line accepted by the data clock pulse 9. The LC display data 8 are data which are conformed to the input specifications of the 8-level data driver 14.

The inputs of the aforementioned product "HD66310" are such that the data for one pixel is composed of 3 bits, and that 4 pixels are received in parallel. In the ensuing description of the illustrated example, the inputs of the 8-level data driver 14 shall be so assumed that the data for one pixel is composed of 3 bits and that the 8 pixels (24 bits) are received in parallel. Shown at numeral 16 is a scan driver, which delivers its output to any of the first scan line 17, the second scan line 18, . . . through the nth scan line 19. That is, the scan driver 16 produces its output voltage for selecting that one of the scan lines 17–19 which corresponds to the horizontal line for displaying the LC horizontal data 15 delivered from the 8-level data driver 14. The LC panel 20 has a resolution of m horizontal dots (3·m pixels) and n vertical lines, and presents the 8-tone displays in accordance with the voltages of the LC horizontal data 15.

Figure 3:
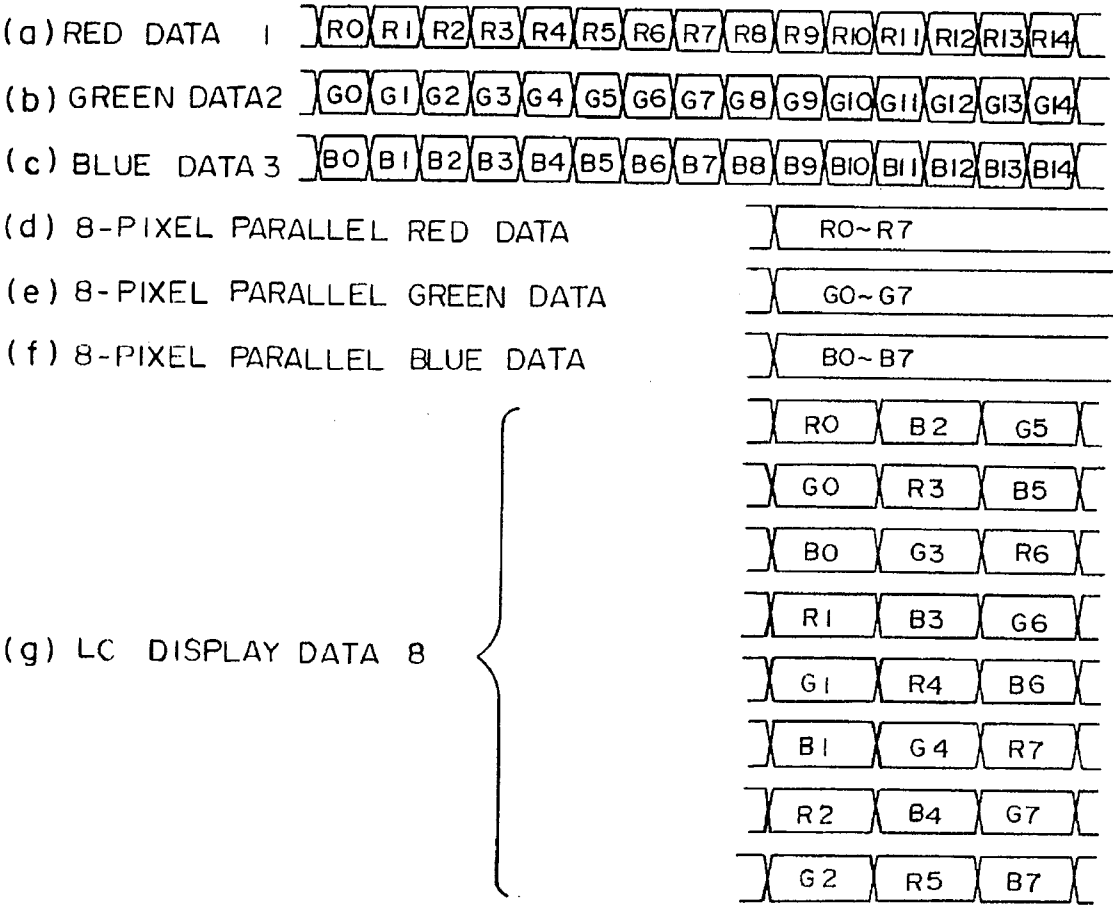
FIG. 3 is a timing chart for explaining the operation of an LC (liquid-crystal) drive signal generator depicted in FIG. 1.

FIG. 3 is a timing chart of the various signals concerning the operation in which the LC drive signal generator 7 produces the LC display data 8 from the input display data 1–3 in the embodiment of FIG. 1. Symbol (a) in FIG. 3 denotes the "red" input display data 1, symbol (b) the "green" input display data 2, and symbol (c) the "blue" input display data 3. The data 1–3 are signals which are simultaneously fed pixel by pixel, and which for one pixel is 3-bit data representative of any one of 8 tones. Symbols (d)–(f) denote those parallel signals for 8 pixels into which the input display data 1–3 fed pixel by pixel as shown at (a)–(c) have been respectively converted. Symbol (g) denotes the LC display data 8. The data 8 are those parallel data for 8 pixels into which all of the red, green and blue data have been rearranged in conformity with the pixel array of the LC panel 20.

Figure 4:
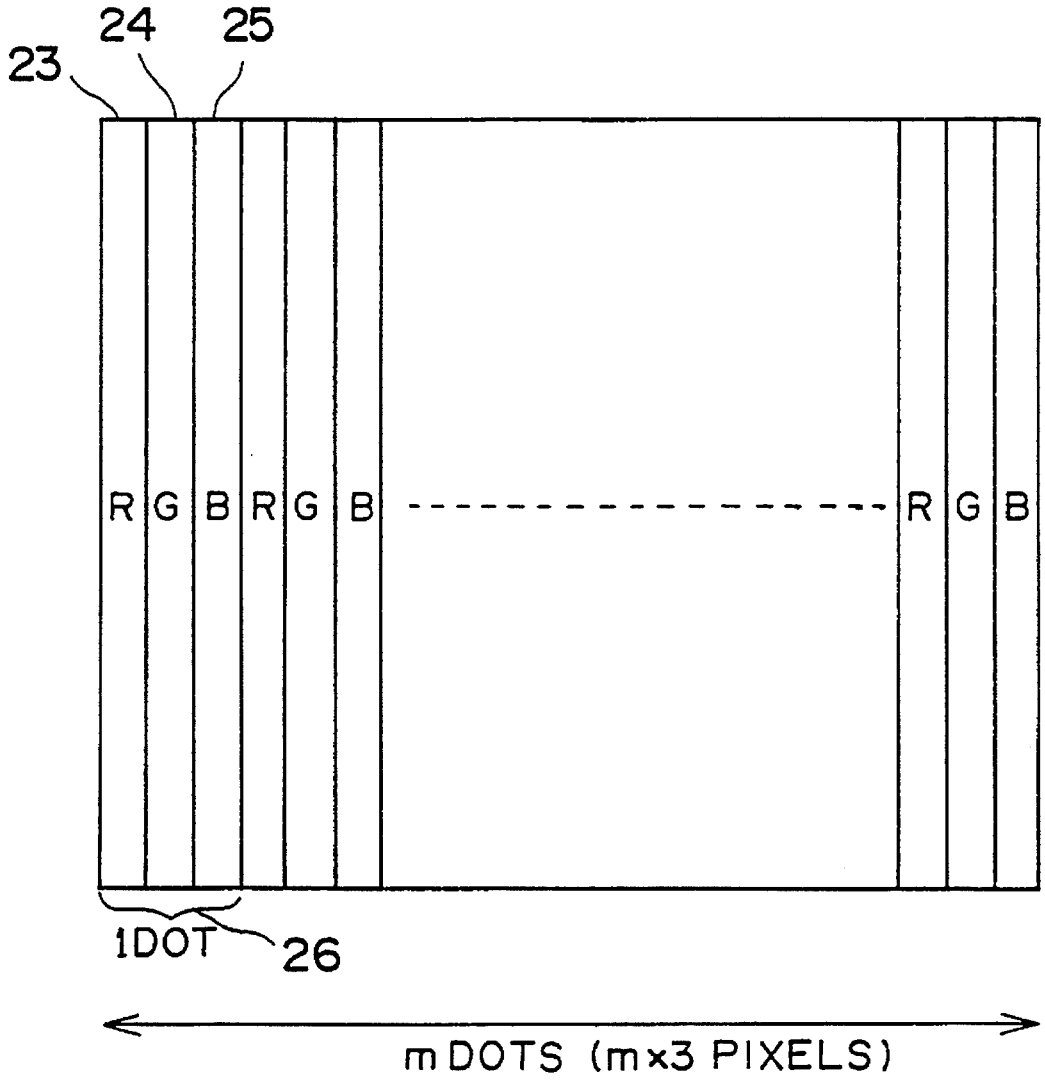
FIG. 4 is a diagram showing the pixel configuration of an LC panel depicted in FIG. 1.
Figure 5:
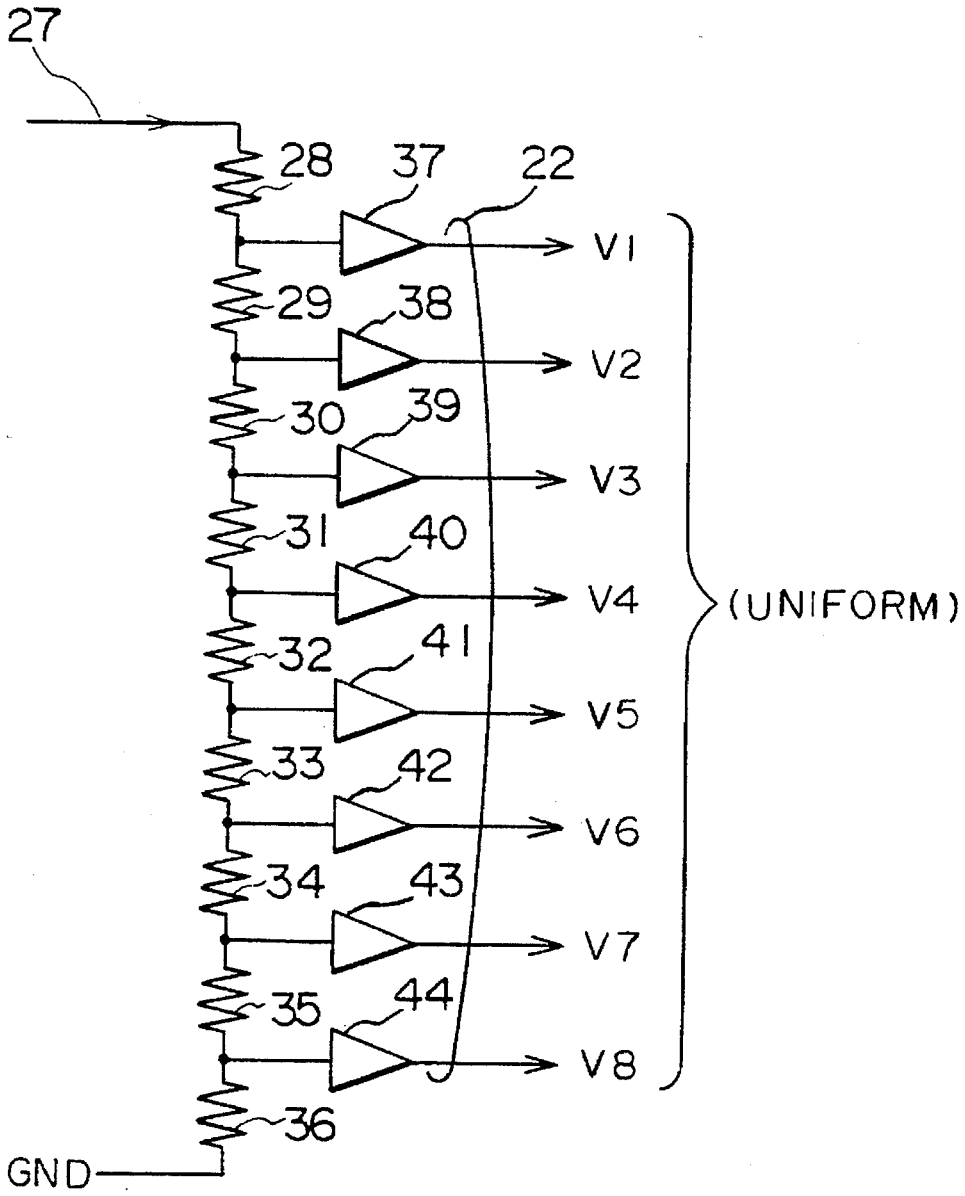
FIG. 5 PRIOR ART
FIG. 5 is a circuit diagram showing the internal arrangement of an 8-level uniform applied LC voltage generator in the prior art.

FIG. 4 illustrates the pixel configuration of the color LC panel 20. The 3 pixels of a "red" pixel 23, a "green" pixel 24 and a "blue" pixel 25 constitute one dot 26. The LC display data 8 are generated in conformity with the depicted pixel array.

Figure 9:
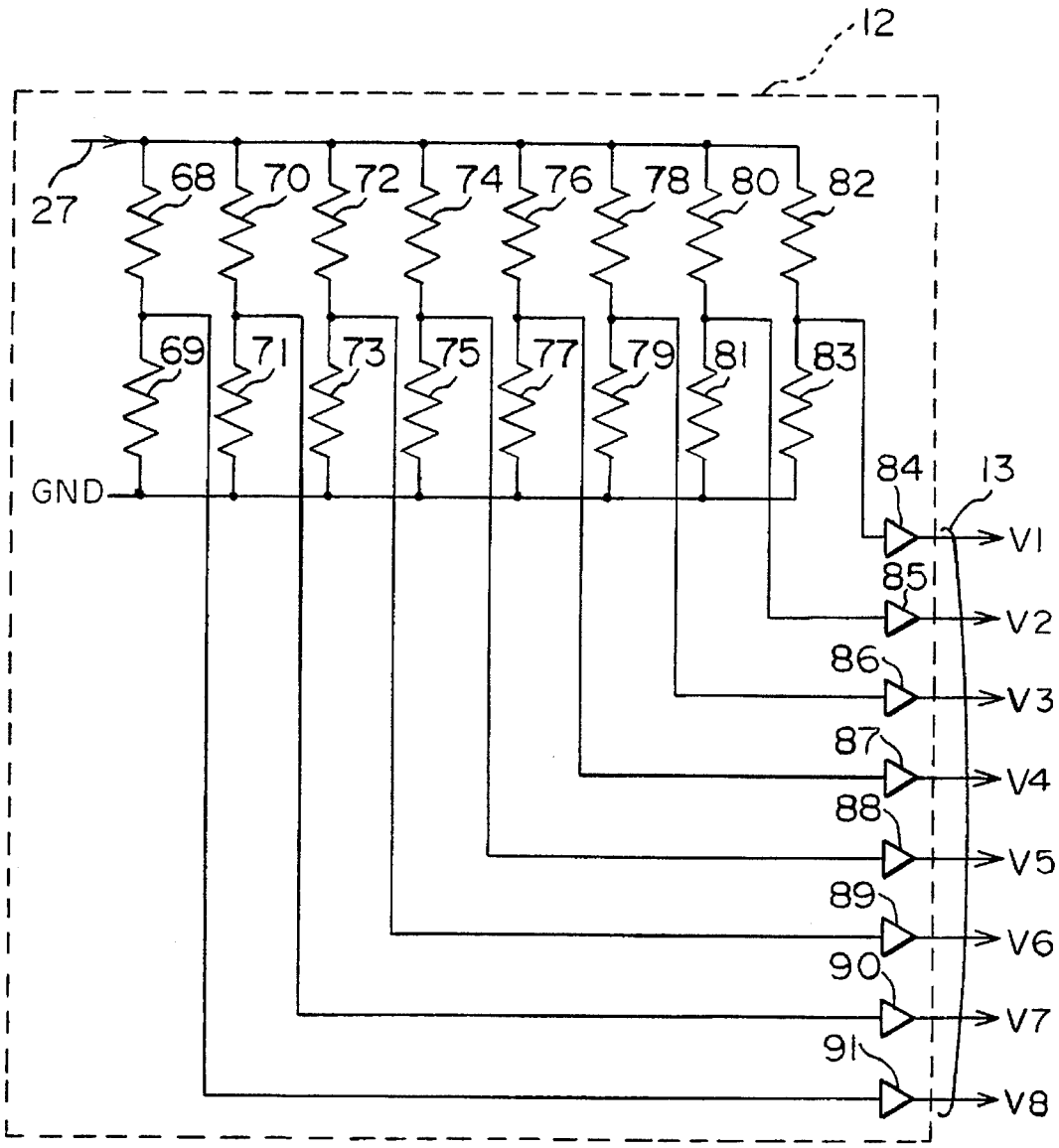
FIG. 9 is a circuit diagram showing the internal arrangement of an 8-level applied LC voltage generator depicted in FIG. 1.

FIG. 9 illustrates an example of the internal circuit arrangement of the 8-level applied LC voltage generator 12 shown in FIG. 1. Numeral 27 indicates an LC driving supply voltage. The voltage generator 12 includes resistors 68–83, and operational amplifiers 84–91. Pairs of resistors 68 and 69, 70 and 71, 72 and 73, 74 and 75, 76 and 77, 78 and 79, 80 and 81, and 82 and 83 divide the LC driving supply voltage 27 so as to deliver the 8-level applied LC voltages 13 (V8–V1) through the corresponding operational amplifiers 91–84, respectively. In this embodiment, the voltages 13 to be applied to the LC panel 20 are set at a relationship of V1>V2> . . . >V7>V8. It is also assumed that the tone or gradation #1 (black display: lowest intensity or brightness level) of each pixel is attained by the voltage V1, that the tone #8 (white display: highest intensity level) thereof is attained by the voltage V8, and that the tones #2–#7 (half-tones: intermediate intensity levels) thereof are respectively attained by the other voltages V2–V7.

Figure 6:
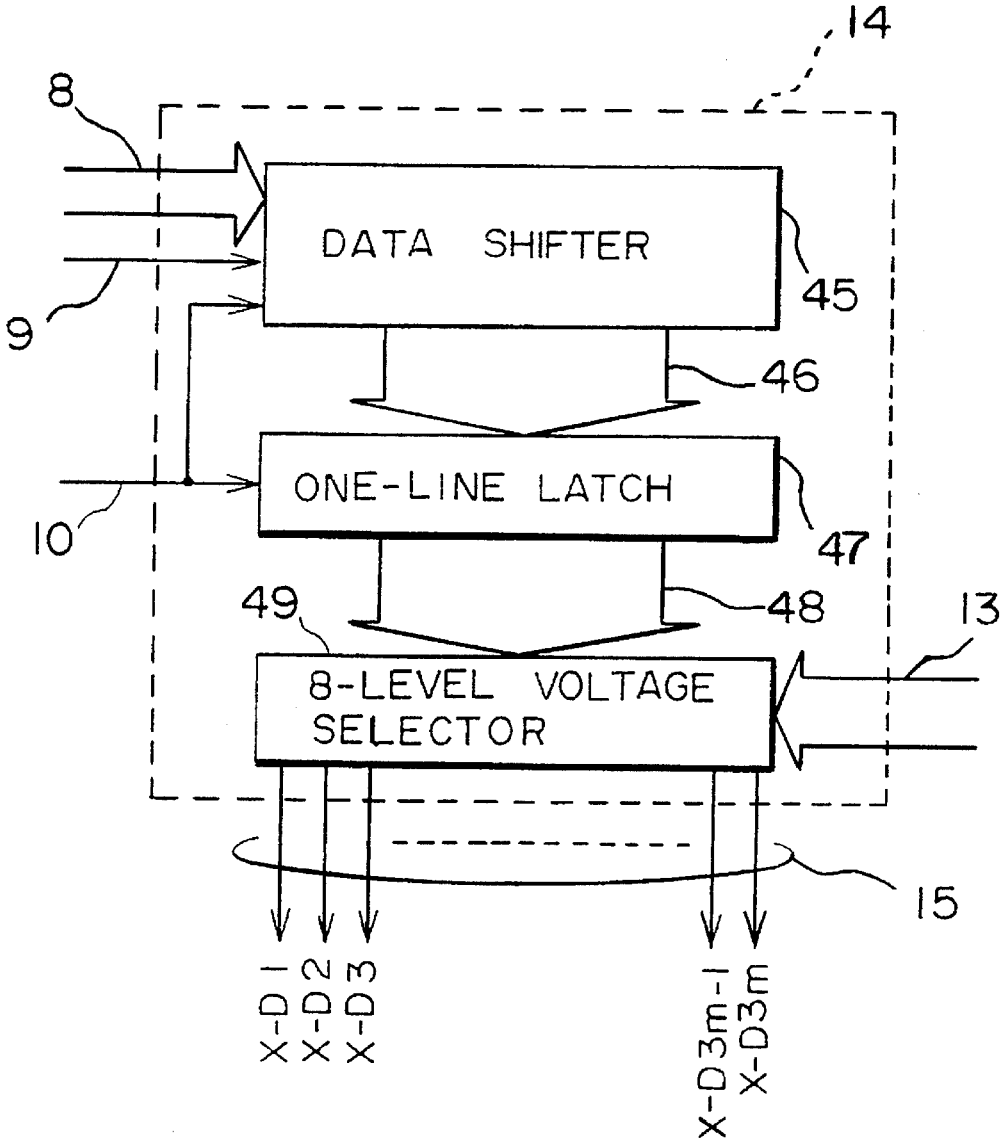
FIG. 6 is a block diagram of an 8-level data driver depicted in FIG. 1.

FIG. 6 is a block diagram showing the details of the 8-level data driver 14. Numeral 45 indicates a data shifter, and numeral 46 shifted data. The data shifter 45 accepts the LC display data 8 for one line within one horizontal period, and delivers them as the shifted data 46 in accordance with the data clock signal 9. Besides, numeral 47 indicates a one-line latch, and numeral 48 display data. The one-line latch 47 latches the shifted data 46 corresponding to one line, and delivers them as the display data 48 in synchronism with the LC horizontal clock 10. An 8-level voltage selector 49 selects one of the 8-level applied LC voltages 13 for each of the output lines thereof in accordance with the display data 48, and delivers the selected voltage levels as the LC horizontal data 15 (X-D1 to X-D3m) to the output lines. The symbols X-D1 to X-D3m signify that the horizontal lines of the LC horizontal data 15 are in the number of (3×m) because the LC panel 20 has the resolution of the m horizontal dots each of which is composed of 3 pixels.

Figure 7:
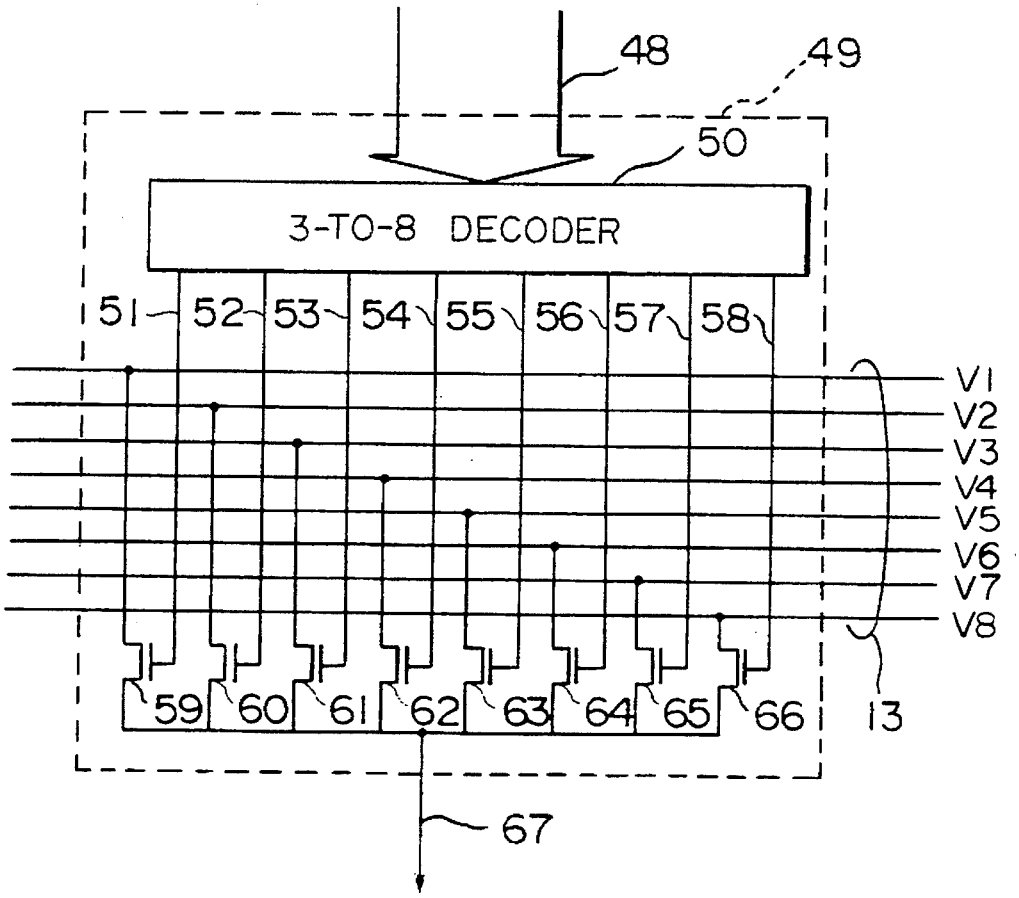
FIG. 7 is a circuit diagram showing the internal arrangement of an 8-level voltage selector depicted in FIG. 6.
Figure 8:
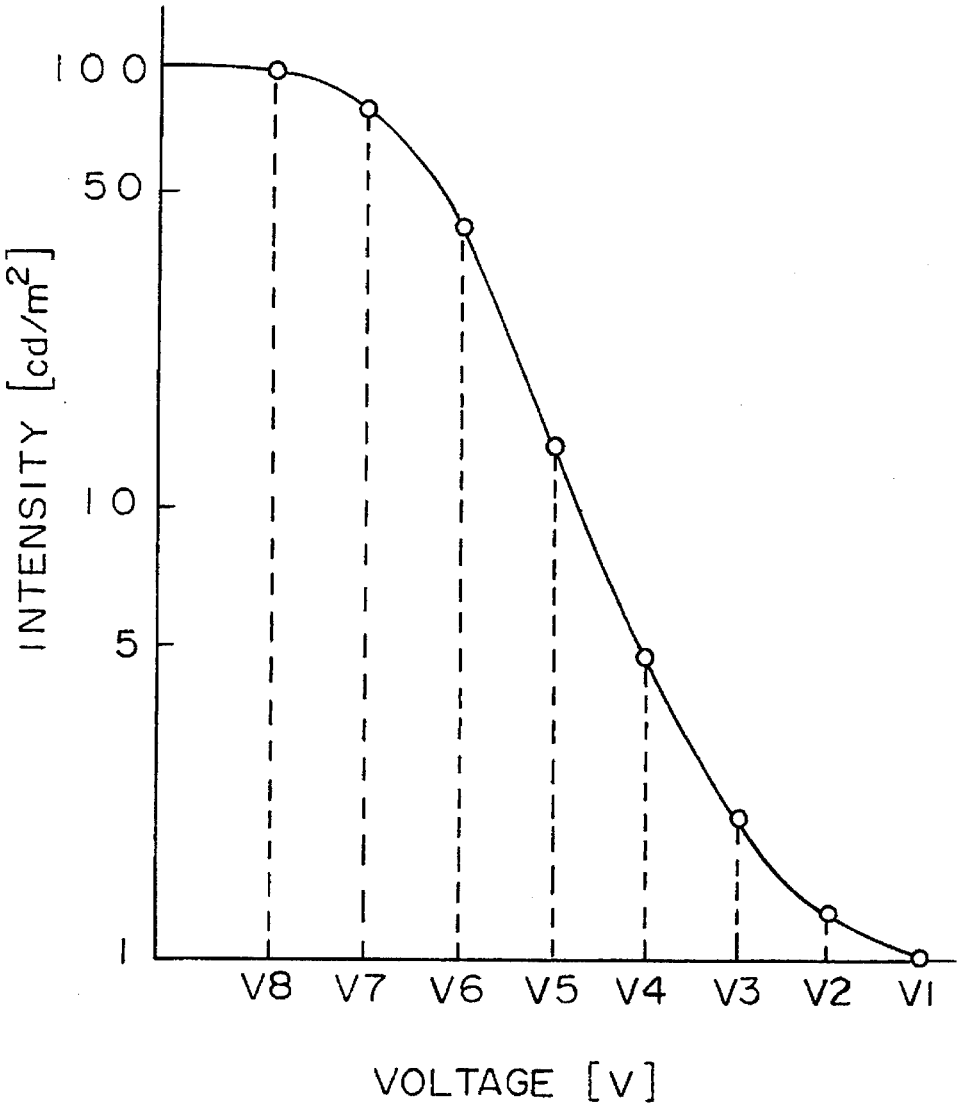
FIG. 8 PRIOR ART
FIG. 8 is a graph showing an example of the relationship between the applied voltage of an LC panel and the display intensity thereof in the prior art.

FIG. 7 is a circuit diagram showing the internal arrangement of the 8-level voltage selector 49 of the 8-level data driver 14. The voltage selector 49 includes a 3-to-8 decoder 50, decoder output lines 51–58 and switching elements 59–66. Numeral 67 indicates an LC horizontal data line, which is one of the output lines for the LC horizontal data (X-D1 to X-D3m). The 3-to-8 decoder 50 brings one of the decoder output lines 51–58 to "1" in accordance with the display data 48 each being composed of 3 bits per pixel, thereby turning "on" one of the switching elements 59–66. Thus, one level of the 8-level applied LC voltages 13 is selected and is delivered to the LC horizontal data line 67.

Now, the operation of this embodiment will be described.

Referring to FIG. 1, the LC drive signal generator 7 produces the LC display data 8 synchronous with the data clock signal 9 for the LC displays from the "red" input display data 1, "green" input display data 2, "blue" input display data 3 and clock signal 4. Also, it produces the data clock signal 9, LC horizontal clock signal 10 and LC head signal 11 which are LC driving signals, from the horizontal clock signal 5 and head signal 6.

The 8-level applied LC voltage generator 12 produces the applied LC voltages 13 (the voltages to be applied to the LC panel 20) of 8 levels whose voltage differences are set as desired as will be detailed later.

Figure 1A:
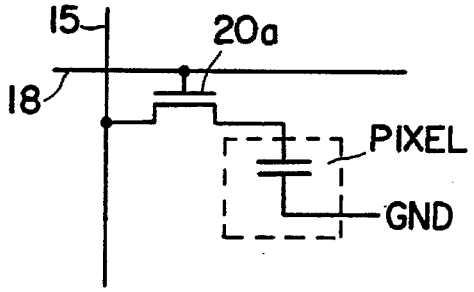
FIG. 1A depicts a type of switching element which can be utilized in a display device within a display system in accordance with the present invention.

The 8-level data driver 14 produces the LC horizontal data 15 from the LC display data 8, data clock signal 9, LC horizontal clock signal 10 and 8-level nonuniform applied LC voltages 13. The scan driver 16 accepts the "1" level of the LC head signal 11 in accordance with the LC horizontal clock signal 10, and supplies the first scan line 17 with the selecting voltage (the output voltage of the scan driver 16 for selecting the horizontal line of the LC panel 20). Thereafter, the selecting voltage of the scan driver 16 is successively shifted to the second scan line 18, and on and on to the nth scan line 19 in accordance with the LC horizontal clock signal 10. Thus, one frame of the LC panel 20 is scanned. On this occasion, the voltages of the LC horizontal data lines 15 are fed from the 8-level data driver 14 to the LC panel 20 while the selecting voltage is delivered from the scan driver 16 on the scan line 17, 18, . . . 19, causing the panel switching elements, such as switching element 20*a* in FIG. 1A, to present a conforming display. Incidentally, the color display operation is effected with $8^3$ (512) colors on the basis of the combination of the 8 tones of the respective primary colors (red, green and blue).

A method of setting the 8-level applied LC voltages 13 adjusted to the visual characteristics of the human eye will be explained in detail.

Figure 10:
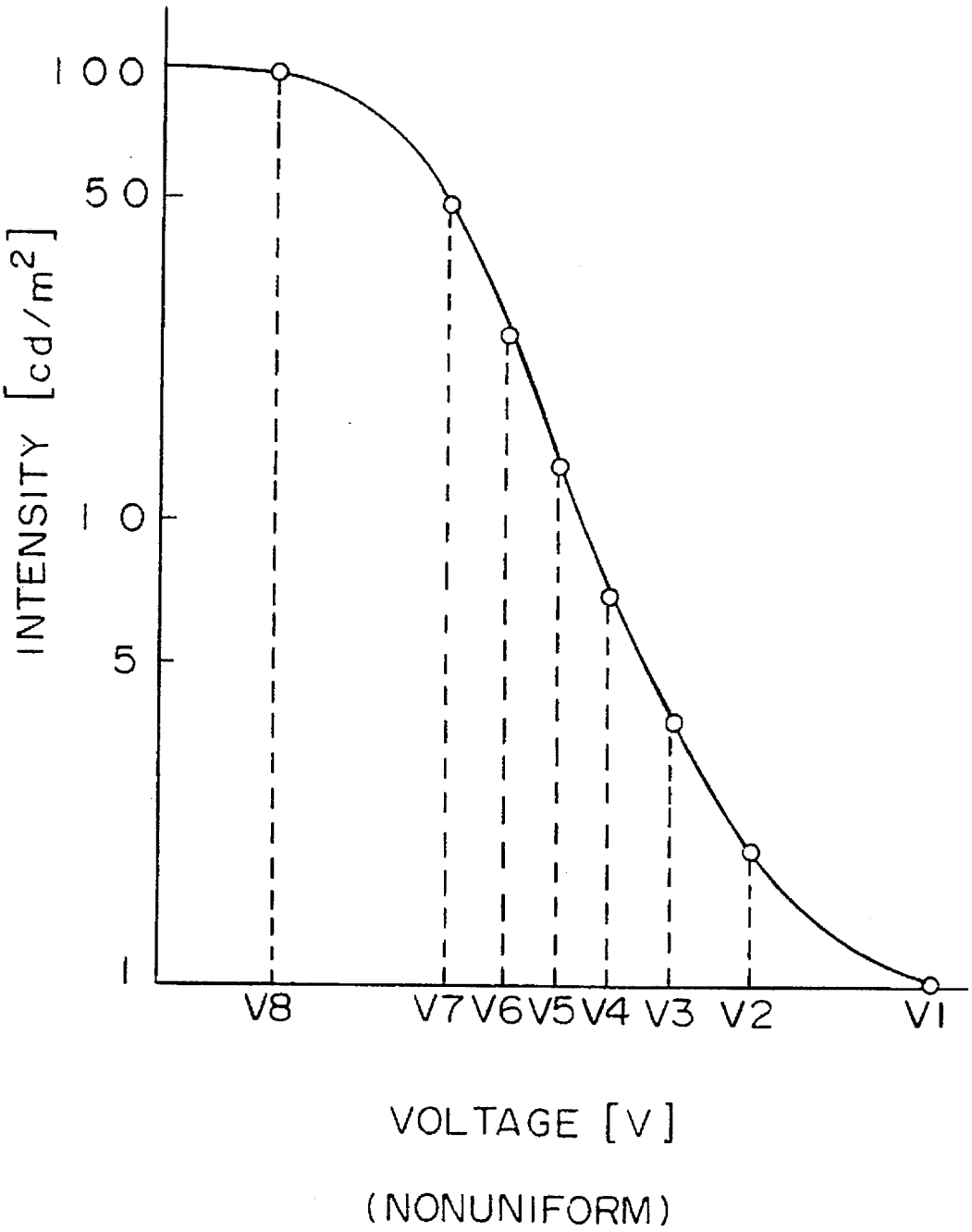
FIG. 10 is a graph showing an example of the setting of 8-level applied LC voltages.
Figure 11:
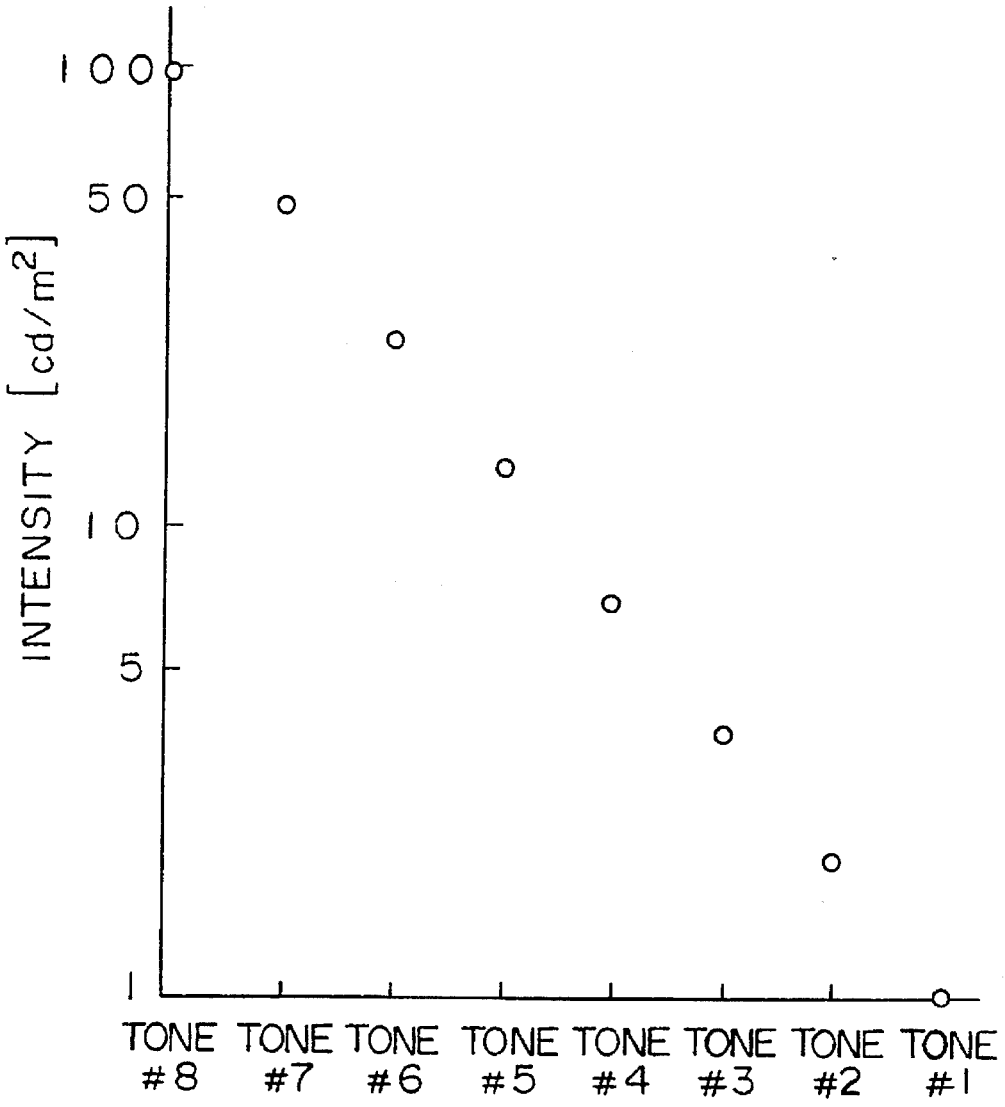
FIG. 11 is a graph showing the characteristics of 8-tone display intensity levels which are attained by the voltage setting illustrated in FIG. 10.

The display intensity or brightness in the case of setting the voltages V1–V8 nonuniformly is illustrated in FIG. 10. The display intensity characteristics of the 8 tones in this case become as shown in FIG. 11. Herein, the tones or gradations #1–#8 are set so as to make uniform the levels of the display intensity on a logarithmic scale.

Figure 12:
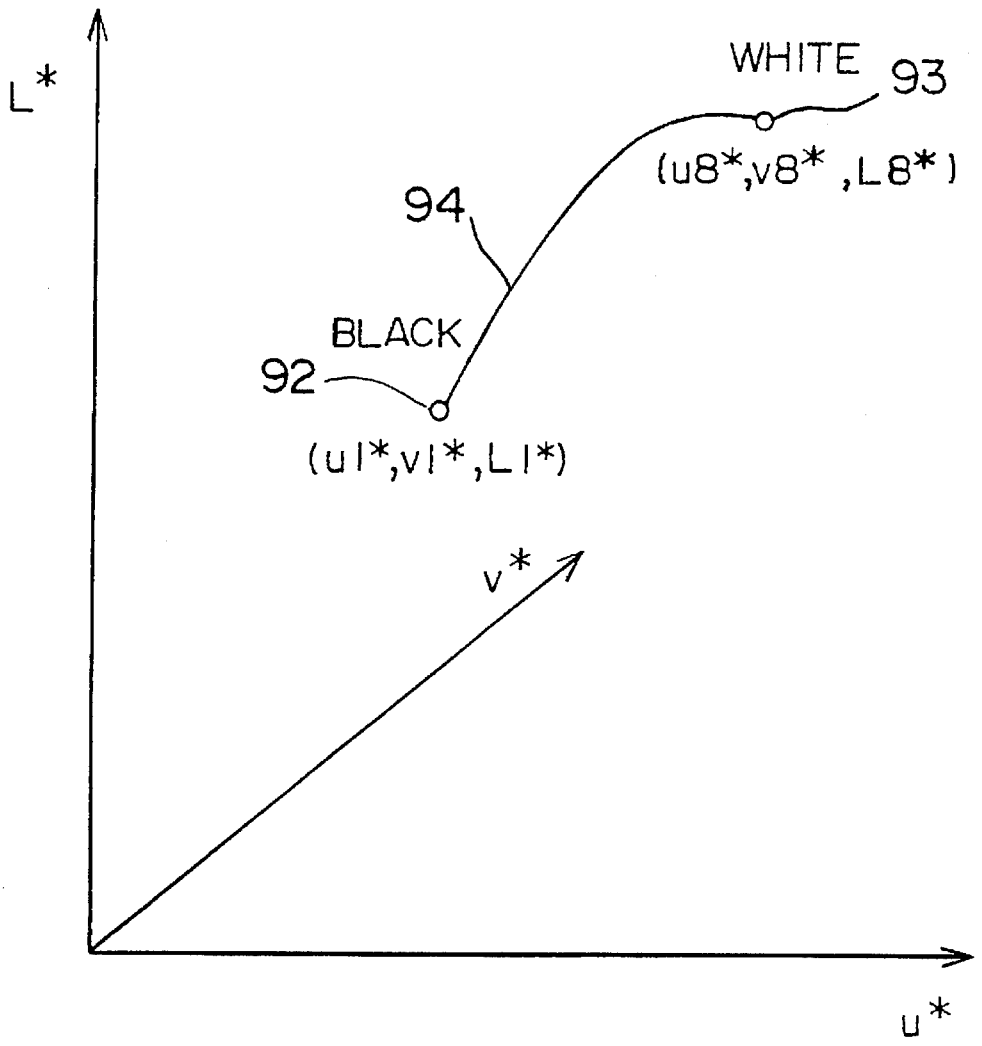
FIG. 12 is a graph showing the coordinates of a white display and a black display within the CIELUV uniform color space.

FIG. 12 illustrates the CIELUV uniform color space stipulated by the CIE (Commission International de l'Eclairage). The distance between coordinate points within this space expresses that difference of colors which is visible to the human eye. Marks * are affixed to the coordinate values of the coordinate point 92 of the black display based on the level V1 among the 8-level applied LC voltages 13 and the coordinate point 93 of the white display based on the level VS. These marks * indicate that psychological factors are considered in addition to coordinates (Y, u', v') obtained by an optical measurement. Shown at numeral 94 is the locus of coordinates obtained by changing the 8-level applied LC voltages 13 from the level V1 to the level V8 for each of the R, G and B pixels. Incidentally, the coordinates are obtained irrespective of the properties (LC material, color filter characteristics, etc.) of the LC panel 20 by conducting the optical measurement after voltage setting. The method of the optical measurement in this embodiment will be stated below.

An optical measuring apparatus employed in this embodiment is a product "1980B" fabricated by PHOTO RESEARCH INC. The coordinate (Y) expressive of the intensity and the coordinates (u', v') expressive of the colors can be obtained by measuring light on the front surface of the LC panel 20 in SPECTRARADIOMETER MODE among the measurement modes of the apparatus "1980B". The range of the measurement is within a circle having a diameter of about 5 mm at the central part of the LC panel 20. The same voltage is applied to all of the R, G and B pixels on each occasion. The coordinates (Y, u', v') obtained by the optical measurement for any desired voltage setting are computed in accordance with Equations (1), whereby they can be reduced to the coordinates within the CIELUV uniform color space:

$$\left.\begin{aligned} L^* &= 116\left(\frac{Y}{Y0}\right)^{1/3} - 16\left(\text{where } \frac{Y}{Y0} > 0.008856\right), \\ u^* &= 13\,L^*(u' - u0'),\ v^* = 13L^*(v' - v0') \end{aligned}\right\} \quad (1)$$

The distances between the coordinates contained in the CIELUV uniform color space are called "color differences" which are the differences of the colors seen by the human eye. Incidentally, coordinate values (Y0, u0', v0') express the intensity and color coordinates of a known reference color (for example, the white of a fluorescent lamp). By way of example, the color difference (dE*) between the black display 92 based on the 8-level applied LC voltage V1 and the white display 93 based on the voltage V8 as shown in FIG. 12 is computed by Eq. (2):

$$de^* = \sqrt{(L8^* - L1^*)^2 + (u8^* - u1^*)^2 + (v8^* - v1^*)^2} \quad (2)$$

Herein, the exemplified distance is a distance in a straight line and is different from a distance extending along the locus 94 depicted in FIG. 12. Accordingly, the distance of the locus 94 can be found in such a way that, while the applied voltage is changed little by little between the levels V1 and V8, the color differences involved between the respective voltages are computed, and the computed color differences are added up. Incidentally, the above equations (1) and (2) are respectively contained on page 143 and page 149 in "Mitsuo Ikeda: Shikisai-kōgaku no Kiso (Fundamentals of Color Engineering)" (issued by Asakura Book Store in 1980).

In this embodiment, while the applied voltage is changed little by little (for example, every 0.1 or 0.2 V) between the levels V1 and V8, the color differences involved between the respective voltages are calculated, and the calculated color differences are added up, thereby finding the distances involved between the respectively adjacent applied voltages and the distance along the locus 94. According to the present invention, in order to make uniform or equalize the color differences among the 8 tones or gradations of the display operation, the distance of the locus 94 is divided by (the number of tones−1), namely, by 7 in the case of the 8-tone display operation. Subsequently, a set of applied voltages (voltages to be applied to the LC panel 20) are evaluated in order that the color differences between the respectively adjacent tones may substantially agree with a value obtained by the division.

After setting the applied voltages, the optical measurement is conducted for the individual tonal displays, and the color differences between the respectively adjacent tones are computed using Eq. (2). Herein, in a case where the computed color differences are different from the requested ones, the steps of the voltage setting, optical measurement and color difference computation are performed again. Such processing is iterated until the requested color differences are obtained. Results thus obtained are listed in Table 2 below.

TABLE 2

| Tone | Voltage value [V] | Color difference |
|---|---|---|
| #1 | 6.50 | |
| #2 | 4.96 | 15.2 |
| #3 | 4.92 | 15.4 |
| #4 | 3.83 | 15.4 |
| #5 | 3.43 | 15.4 |
| #6 | 3.00 | 15.4 |
| #7 | 2.51 | 15.3 |
| #8 | 1.77 | 15.3 |

In this table, the value of each "color difference" represents the color difference with respect to the tone of the adjoining upper row. For example, the value of the color difference of the row of the tone #3 represents the color difference with respect to the tone #2. Here, the color differences are substantially uniform and are 15.3 on average.

Figure 13:
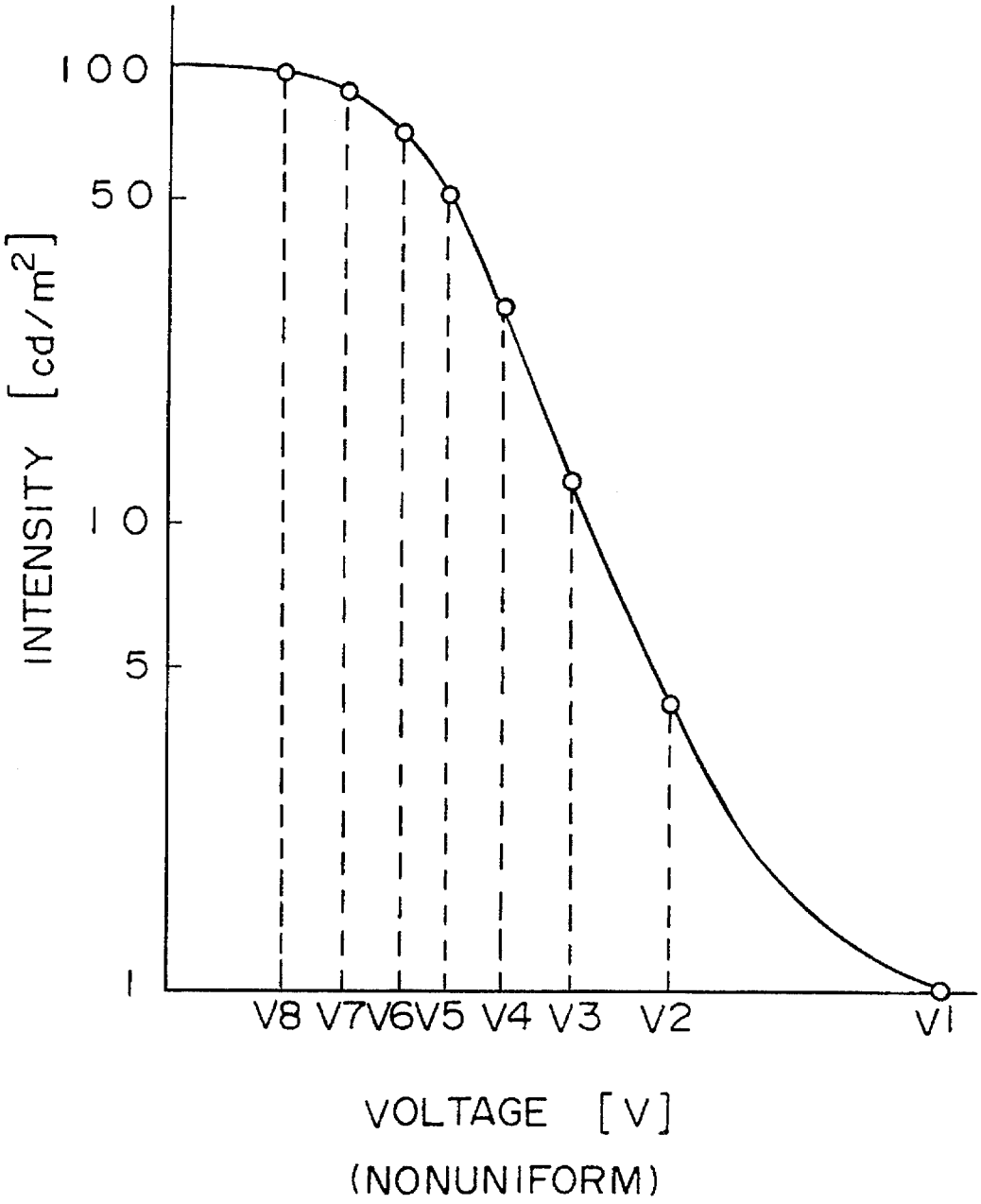
FIG. 13 is a graph showing display intensity levels in the case of setting applied voltages so as to make uniform color differences.
Figure 14:
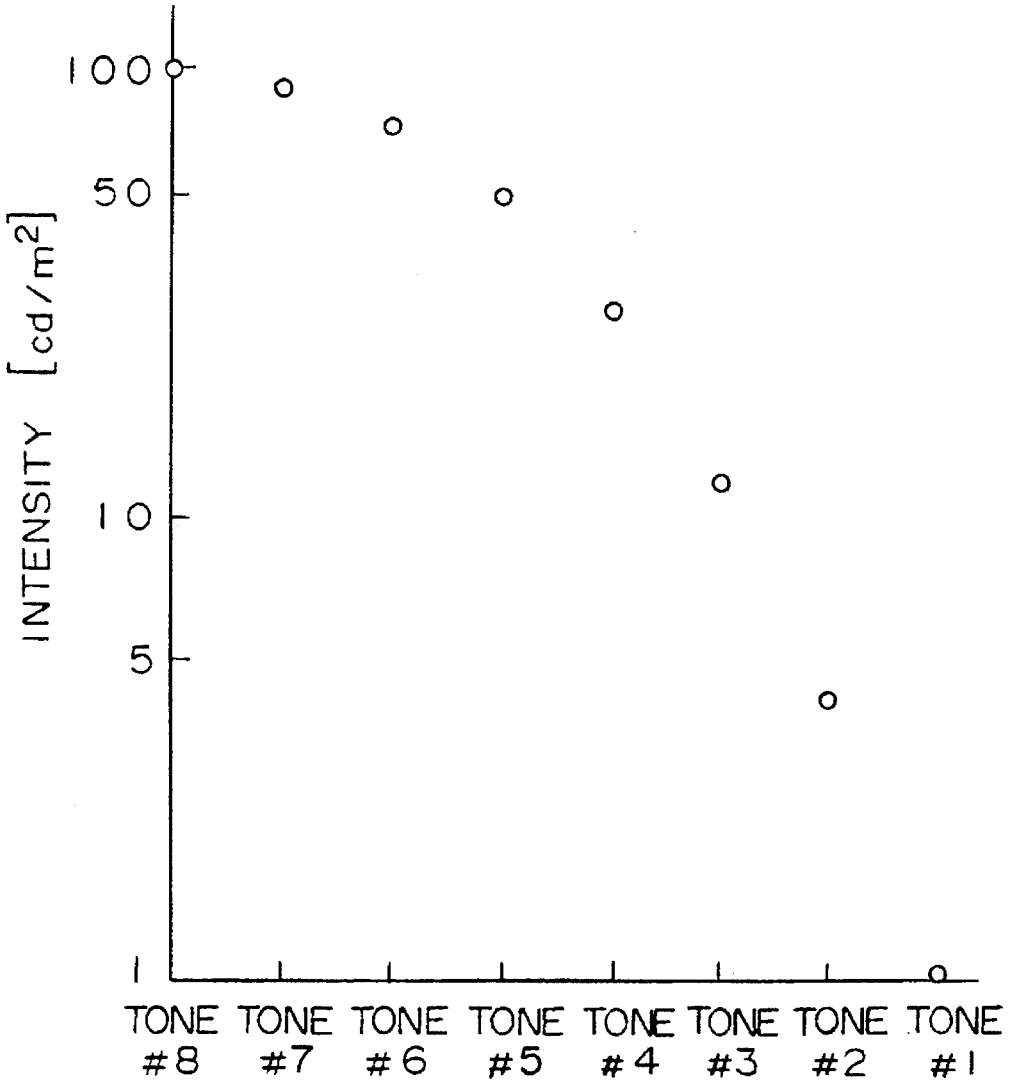
FIG. 14 is a graph showing the characteristics of the 8-tone display intensity levels which are attained by the voltage setting illustrated in FIG. 13.

The display intensity or brightness levels of the LC panel 20 attained by setting the 8-level applied LC voltages 13 as listed in Table 2 become as shown in FIG. 13, while the display intensity characteristics of the 8 tones become as shown in FIG. 14.

Meanwhile, an embodiment in the case of increasing the number of tones from 8 to 16 in accordance with an FRC (frame rate control) mode will be described with reference to FIG. 2, FIG. 15, and Tables 3 and 4.

The "FRC mode" is a method wherein the displays of two tones for a certain pixel are changed-over alternately in successive frames (each frame corresponding to one frame scan period), thereby attaining a tone intermediate between the two tones.

Figure 2:
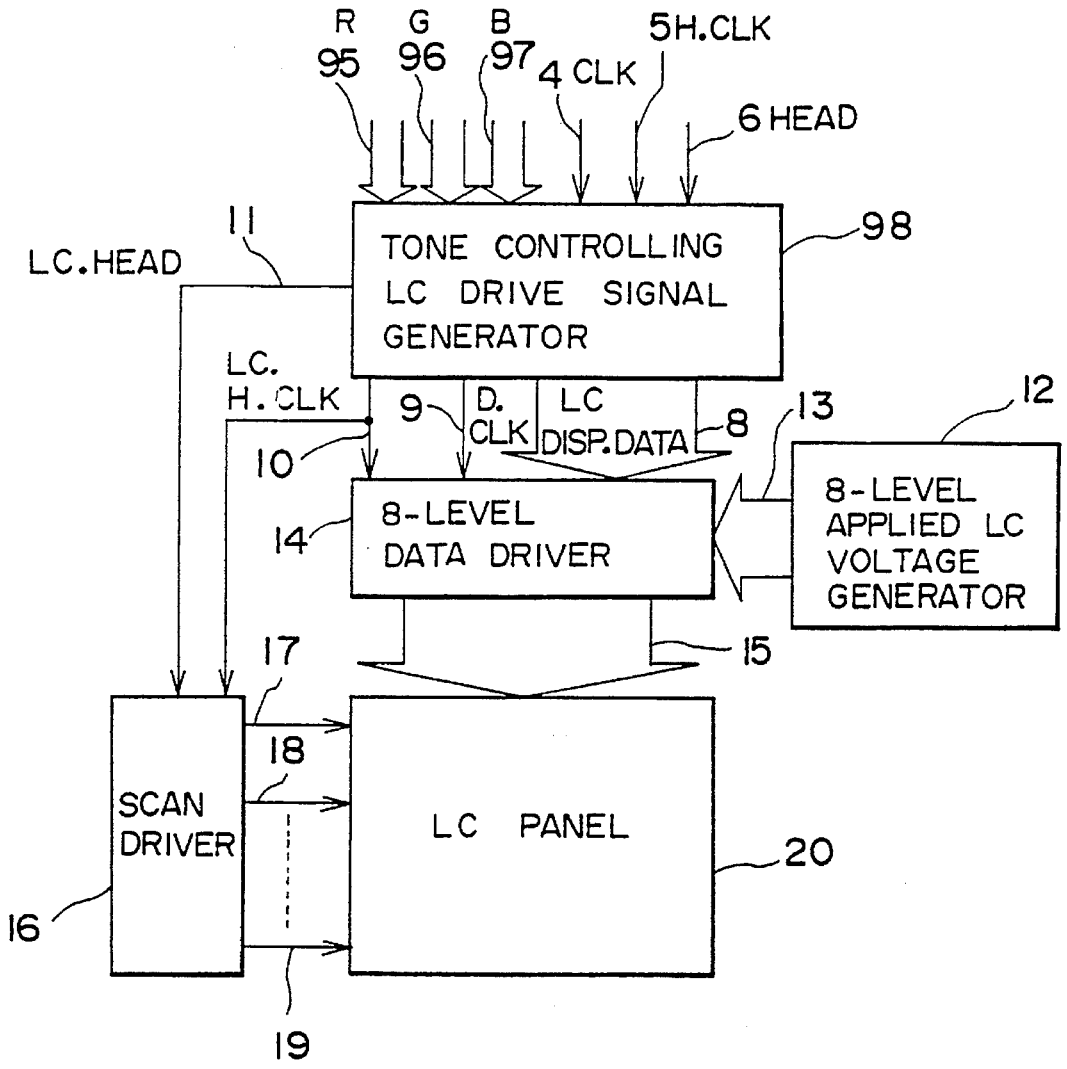
FIG. 2 is a block diagram of an embodiment of a 16-tone display system which adopts the present invention.

FIG. 2 is a block diagram of the embodiment of an LC (liquid-crystal) multiple-tone display system which employs the FRC mode. Referring to the figure, numeral 95 indicates "red" input display data, numeral 96 "green" input display data, numeral 97 "blue" input display data, and numeral 4 a clock signal. In this embodiment, each of the input display data 95–97 is assumed to be 4-bit data which is fed in synchronism with the clock signal 4. Shown at numeral 98 is a tone controlling LC drive signal generator, which delivers LC display data 8, a data clock signal 9, an LC horizontal clock signal 10 and an LC head signal 11. More specifically, the tone controlling LC drive signal generator 98 converts the input display data 95–97 each being composed of 4 bits, into the LC display data 8 composed of 3 bits. Also, it produces the data clock signal 9, LC horizontal clock signal 10 and LC head signal 11 in the same manner as in the foregoing embodiment. An 8-level applied LC voltage generator 12 produces 8-level applied LC voltages (voltages to be applied to an LC panel 20) 13 for the FRC mode. A method of converting the 4-bit input display data 95–97 into the 3-bit LC display data 8, and a method of setting the 8-level applied LC voltages 13 will be detailed later. An 8-level data driver 14, a scan driver 16 and the LC panel 20 are similar to the corresponding devices in the case of the 8-tone display operation, respectively.

Figure 15:
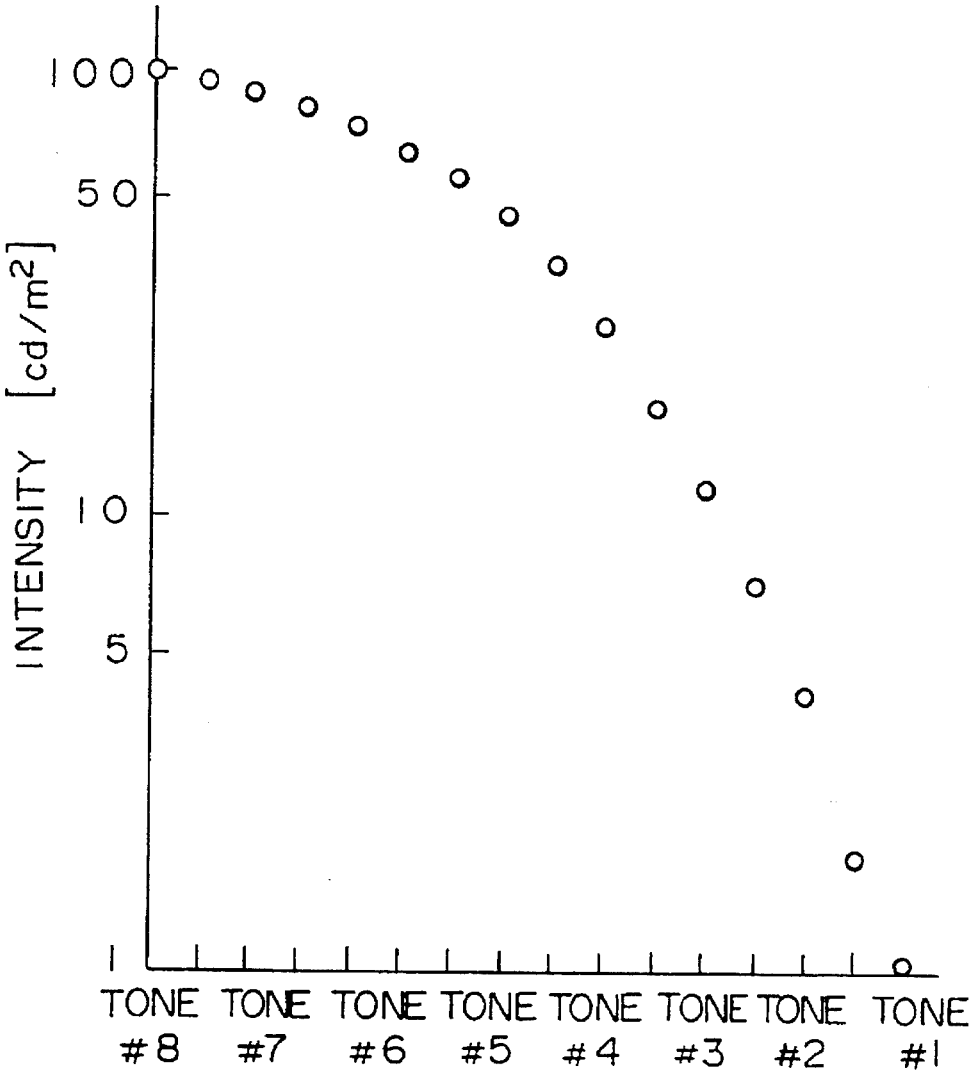
FIG. 15 is a graph showing the display intensity characteristics of a 16-tone display operation according to the present invention.

FIG. 15 is a graph showing the display intensity or brightness characteristics of 16-tone displays which are presented in each of colors R (red), G (green) and B (blue) by this embodiment.

In order to explain the details of the operation of this embodiment, FIGS. 2 and 15 will be referred to again.

In the construction of FIG. 2, the LC drive signal generator 98 produces the LC display data 8 of 3 bits synchronous with the data clock 9 for the LC display operation, on the basis of the "red" input display data 95, "green" input display data 96 and "blue" input display data 97 which are respectively fed in serial 4-bit units and in synchronism with the clock signal 4. An example of the conversion of the 4-bit data into the 3-bit data is indicated in Table 3 below.

That is, Table 3 exemplifies the data of 16-tone displays and the values of attained color differences in this embodiment.

TABLE 3

| Tone | 4-bit data | 3-bit data | Voltage value [V] | Color diff. |
|---|---|---|---|---|
| #1 | 0000 | 000 | 6.50 | |
| #2 | 0001 | 000–001 | 6.50–4.57 | 4.695 |
| #3 | 0010 | 001 | 4.57 | 5.751 |
| #4 | 0011 | 001–010 | 4.57–4.02 | 6.242 |
| #5 | 0100 | 010 | 4.02 | 6.943 |
| #6 | 0101 | 010–011 | 4.02–3.72 | 6.212 |
| #7 | 0110 | 011 | 3.72 | 6.714 |
| #8 | 0111 | 011–100 | 3.72–3.37 | 7.240 |
| #9 | 1000 | 100 | 3.37 | 7.435 |
| #10 | 1001 | 100–101 | 3.37–3.12 | 8.192 |
| #11 | 1010 | 101 | 3.12 | 8.059 |
| #12 | 1011 | 101–110 | 3.12–2.77 | 7.573 |
| #13 | 1100 | 110 | 2.77 | 7.585 |
| #14 | 1101 | 101–111 | 3.12–1.77 | 5.689 |
| #15 | 1110 | 110–111 | 2.77–1.77 | 7.072 |
| #16 | 1111 | 111 | 1.77 | 10.707 |

Each of the tones which indicates two sorts of 3-bit data, is subjected to the FRC mode. The tone controlling LC display data generator 98 changes-over the two sorts of data alternately in the successive frames.

Besides, the LC drive signal generator 98 produces the data clock signal 9, LC horizontal clock signal 10 and LC head signal 11 which are LC driving signals, from a horizontal clock signal 5 and a head signal 6 in the same manner as in the foregoing case of the 8-tone display operation.

The 8-level applied LC voltage generator 12 produces the 8-level applied LC voltages (voltages to be applied to the LC panel 20) 13 the differences of which are set as desired. The voltages are set so that the LC panel 20 may exhibit intensity or brightness characteristics similar to those in the case of the 8-tone display operation. The values of the voltages and the color differences between the respectively adjacent tones or gradations on that occasion are listed in Table 3. As seen from the table, the color differences have errors of ±50 [%] or so with respect to their average value of 7.1, but the errors pose no problem in vision. The 16-tone display intensity characteristics shown in FIG. 15 are similar to the 8-tone display intensity characteristics shown in FIG. 14. Incidentally, the large errors of the color differences in this embodiment are ascribable to the fact that, with the FRC operation, when the voltage value of any tone not based on the FRC (for example, the tone #3) is changed, also the voltage values of the FRC-based tones adjoining the tone (the tones #2 and #4) change, so the color differences are difficult to make uniform.

The 8-level data driver 14 produces LC horizontal data 15 from the LC display data 8, data clock signal 9, LC horizontal data 10 and 8-level nonuniform applied LC voltages 13 in the same manner as in the foregoing embodiment shown in FIG. 1. The scan driver 16 accepts the "1" level of the LC head signal 11 in accordance with the LC horizontal clock signal 10, and supplies the first scan line 17 with a selecting voltage. Thereafter, the selecting voltage of the scan driver 16 is successively shifted to the second scan line 18, and on and on to the nth scan line 19 in accordance with the LC horizontal clock signal 10. Thus, one frame of the LC panel 20 is scanned. On this occasion, the voltages on the LC horizontal data lines 15 are fed from the 8-level data driver 14 to the LC panel 20, while the selecting voltage is delivered from the scan driver 16 on the scan line 17, 18, . . . 19, causing the panel switching elements, such as switching element 20*a* in FIG. 1A, to present a conforming display.

Moreover, 16 tones or gradations which are seen uniformly or in a well-balanced manner in each of the colors of "red", "green" and "blue" by the human eye can be attained by modifying the embodiment of FIG. 2 as follows: Three 8-level applied LC voltage generators 12 are disposed for the colors of, respectively red, green and blue independently of one another. Also, the tone controlling LC drive signal generator 98 converts the 4-bit data into the 3-bit data for the colors of red, green and blue independently of one another.

Table 4 indicates another example of the combination between a voltage setting and the FRC mode for presenting 16-tone displays which have the intensity or brightness characteristics as shown in FIG. 15. Even when the combination is changed, the 16-tone displays uniformly visible to the human eye can be obtained by conforming the intensity characteristics to those shown in FIG. 15.

TABLE 4

| Tone | Voltage value [V] |
|---|---|
| #1 | 7.00 |
| #2 | 7.00–4.60 |
| #3 | 7.00–4.00 |
| #4 | 4.60 |
| #5 | 4.60–4.00 |
| #6 | 4.00 |
| #7 | 4.00–3.62 |
| #8 | 3.63 |
| #9 | 3.62–3.21 |
| #10 | 3.21 |
| #11 | 2.99 |
| #12 | 2.99–2.59 |
| #13 | 2.59 |

TABLE 4-continued

| Tone | Voltage value [V] |
|---|---|
| #14 | 3.21–0.01 |
| #15 | 2.99–0.01 |
| #16 | 0.01 |

Even in a case where the number of tones or gradations has been further increased, tonal displays seen to be uniform by the human eye can be presented by conforming intensity or brightness characteristics to a curve as shown in FIG. 15.

According to the present invention, the color differences between the respectively adjacent tones of a tonal display operation are made uniform, whereby multiple-tone displays uniformly visible to the human eye can be obtained.

What is claimed is:

1. A multiple-tone display system for providing multiple-tone representations for display on a display device having a large number of pixels arrayed in a dot matrix, said display system comprising:

data conversion means for receiving multiple-tone display information containing a plurality of bits per pixel, and sequentially converting said multiple-tone display information into display data corresponding to one horizontal line on the display device;

drive voltage generation means for producing a plurality of drive voltage levels, said drive voltage generation means including a group of voltage dividing resistors for dividing a reference voltage by respective unequal division ratios to provide the plurality of drive voltage levels, the differences between adjacent ones of the drive voltage levels being non-uniform and being determined so as to make substantially uniform color differences, as seen by a human eye, between every pair of tones adjacent in display intensity among a plurality of tones that can be displayed, according to said multiple-tone display information;

data drive means connected to said drive voltage generation means and said data conversion means, for selecting one of said plurality of drive voltage levels from said drive voltage generation means for every pixel on one line of the display device and then applying the selected drive voltage level to the display device in accordance with said display data delivered from said data conversion means; and scan drive means for selecting one horizontal line on the display device which is to be successively displayed, in synchronism with the operation of said data conversion means and said data drive means.

2. A multiple-tone display system as defined in claim 1, further comprising a display device including for each pixel thereof a switching element and a liquid crystal which is controlled by said switching element.

3. A multiple-tone display system as defined in claim 1, wherein said multiple-tone display information contains m bits per pixel, and wherein said drive voltage generation means produces M drive voltage levels where m is an integer greater than 1, and $M=2^m$.

4. A multiple-tone display system as defined in claim 1, wherein the color differences correspond to distance between coordinate points in a CIELUV uniform color space, the coordinate points being defined by the respective drive voltage levels produced by said device voltage generation means.

5. A multiple-tone display system as defined in claim 1, further comprising a display device for providing a display of the multiple tone representation.

6. A multiple-tone display system as defined in claim 5, wherein said display device includes a plurality of display dots, each display dot constituted by pixels of red, green and blue, and wherein color displays in $M^3$ colors can be presented, where M is the number of drive voltage levels produced by said drive voltage generation means.

7. A multiple-tone display system as defined in claim 6, wherein said data conversion means includes data converters for colors red, green and blue, said data converters being respectively disposed independently of one another.

8. A multiple-tone display system as defined in claim 5, wherein:

said multiple-tone display information contains (m+1) bits per pixel;

said drive voltage generation means produces M drive voltage levels;

said data conversion means converts selected multiple-tone display information of (m+1) bits alternately in successive frames of said display device into two data words of m bits each and of unequal value to cause said drive voltage generation means alternatingly to produce two corresponding unequal drive voltage levels, thereby producing substantially N different tones on the basis of said M drive voltage levels, where m is an integer greater than 1, and $M=2^m$.

9. A multiple-tone display system as defined in claim 8, wherein the division ratios of said drive voltage generation means limit errors of said color differences between pairs of tones adjacent in display intensity to within ±50%.

10. A multiple-tone display system as defined in claim 5, wherein said data conversion means converts the multiple-tone display information alternately in successive frames of said display device into two data words of unequal value, thereby producing different tones substantially N different tones where M is the number of drive voltage levels, and N>M.

11. A multiple-tone display system as defined in claim 10, wherein the division ratios of said drive voltage generation means limit errors of said color differences between pairs of tones adjacent in display intensity to within ±50%.

* * * * *